US005460120A

United States Patent [19]

Paul et al.

[11] Patent Number: 5,460,120

[45] Date of Patent: Oct. 24, 1995

[54] APPARATUS FOR COATING CORRUGATED SHEET MATERIAL

[75] Inventors: William C. Paul, Mt. Vernon; Ronald F. Sieloff, Evansville, both of Ind.

[73] Assignee: General Electric Co., Pittsfield, Mass.

[21] Appl. No.: 210,518

[22] Filed: Mar. 17, 1994

[51] Int. Cl.[6] ..... B05C 1/06

[52] U.S. Cl. ..... 118/264; 118/58; 118/109; 118/300; 118/642

[58] Field of Search ..... 118/264, 265, 118/269, 109, 300, 304, 118, 70, 104, 413, 261, 642, 58; 156/200, 201, 462, 578; 425/94, 369, 336; 15/256.5

[56] References Cited

U.S. PATENT DOCUMENTS

| | | | |
|---|---|---|---|
| 3,012,923 | 12/1961 | Slayter | 425/336 |
| 3,024,496 | 3/1962 | Colombo | 264/268 |
| 3,066,046 | 11/1962 | Walton | 118/264 |
| 3,340,087 | 9/1967 | Mazzda | 118/70 |
| 3,448,720 | 6/1969 | Graham | 118/109 |
| 4,712,507 | 12/1987 | Helling | 118/264 |
| 4,924,800 | 5/1990 | Tanaka | 118/58 |

*Primary Examiner*—W. Gary Jones
*Assistant Examiner*—Laura E. Edwards

[57] ABSTRACT

An applicator for coating sheet material has a relatively thick compressible, saturable layer for engaging the sheet which is effective to apply an optically clear coating when saturated with a flood of liquid coating composition. The coated article has virtually no visible defects and has high optical transmission and low haze.

14 Claims, 2 Drawing Sheets

Fig. 4
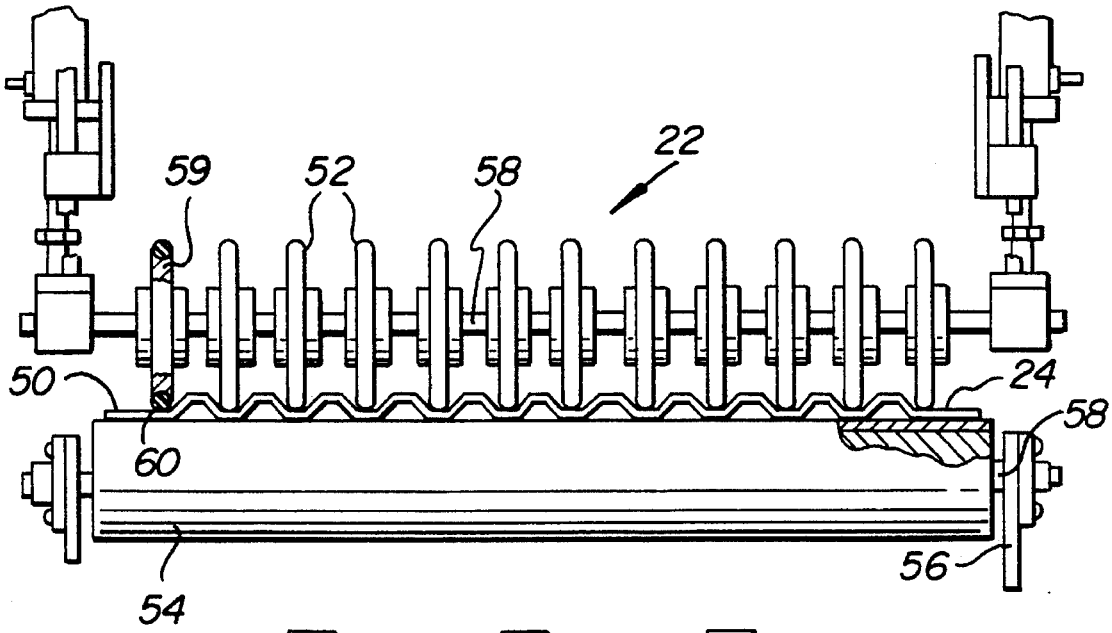
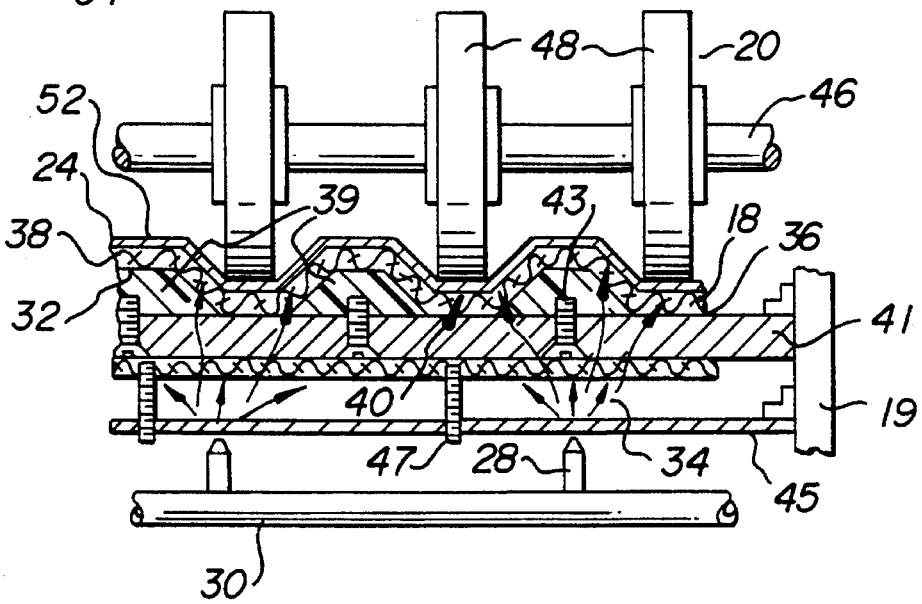
Fig. 2

APPARATUS FOR COATING CORRUGATED SHEET MATERIAL

BACKGROUND OF THE INVENTION

The invention is directed to a method and apparatus for coating sheet material and particularly to a method and apparatus for coating corrugated material with a curable coating free of optical defects, and the coated article.

High strength sheet materials may be continuously corrugated by directing thermo formable sheet material between a pair of interdigitated forming rollers and then through a closely spaced cooled calibrator having the profile corresponding to the desired final shape. Such a system is described in United States Patent Application of Willie Charles Paul entitled "Method and Apparatus for Corrugating Sheet Materials", Ser. No. 07/960,489, filed Oct. 13, 1992, now U.S. Pat. No. 5,340,518 Attorney Docket No. 8CS-5377, assigned to the assignee herein, the teachings of which are incorporated herein by reference. The resulting product has good optical properties and is strong.

Clear, corrugated sheet is useful in greenhouse applications. However, it is necessary to coat the sheet material with an anti-drip, condensate coating. The coating is a wetting agent that allows moisture in the greenhouse atmosphere to condense on the underside of the sheet without fogging and without dripping. The condensed moisture then flows along the corrugated sheet to a collector or gutter structure, near a lower end. It is difficult to uniformly coat corrugated sheet materials because the shape is irregular. For the same reason, corrugated sheet is difficult to doctor. Also, the coating tends to form bubbles which reduce the transparency and optical clarity which is undesirable. Various coating techniques have proved ineffective, including spraying, spraying and thereafter applying a doctor blade or spraying and thereafter doctoring with an air knife. A need therefore exists for a method and apparatus for coating corrugated sheet materials with a curable coating free of optical defects.

SUMMARY OF THE INVENTION

The present invention obviates and eliminates the disadvantages and shortcomings of the described prior arrangements. In particular, the present invention is based upon the discovery that an applicator formed of a relatively thick compressible, saturable layer is effective to apply an optically clear coating when saturated with a flood of liquid coating composition.

In a particular embodiment, the invention is directed to an apparatus for continuously depositing a curable liquid condensate coating, free of optical defects, on at least one coatable surface of a transparent sheet. The sheet is movable with one side disposed in a downward facing direction. An applicator is disposed transverse to the direction of motion and engages the coatable side. The applicator includes a support surface and a relatively thick, saturable layer sleeved over the surface. Spray deposition means is disposed upstream of the applicator for directing a flooding stream of curable liquid onto the coatable side. The applicator becomes saturated with the curable liquid and coats the sheet with a layer of selected thickness while carrying away excess liquid without leaving visible defects on the sheet.

In another embodiment, the invention comprises an apparatus for continuously coating corrugated sheet, further including a backing roller having a plurality of interdigitated rollers on a common axis disposed for engaging the corrugations in the sheet opposite the applicator which is shaped for conforming to the corrugations.

In accordance with the invention, there has been provided a method for coating sheet material comprising movably carrying the sheet with at least one coatable side disposed in a downwardly facing direction and engaging the coatable side into contact with a resilient saturable applicator. A flooding stream of coating material is directed at the coatable side upstream of the applicator which becomes saturated with the liquid. Excess curable liquid is carried away without leaving noticeable optical defects in the coating. The coating thereafter dries or cures to a durable finish. A coated article, free of visible defects has also been provided.

DESCRIPTION OF THE DRAWINGS

FIG. 2 is a fragmentary end view of the coating apparatus viewed from the upstream end with the applicator and backing roller engaging the sheet material;

FIG. 4 is a fragmentary end view of the primary drive; and

DESCRIPTION OF THE INVENTION

Figure 1:
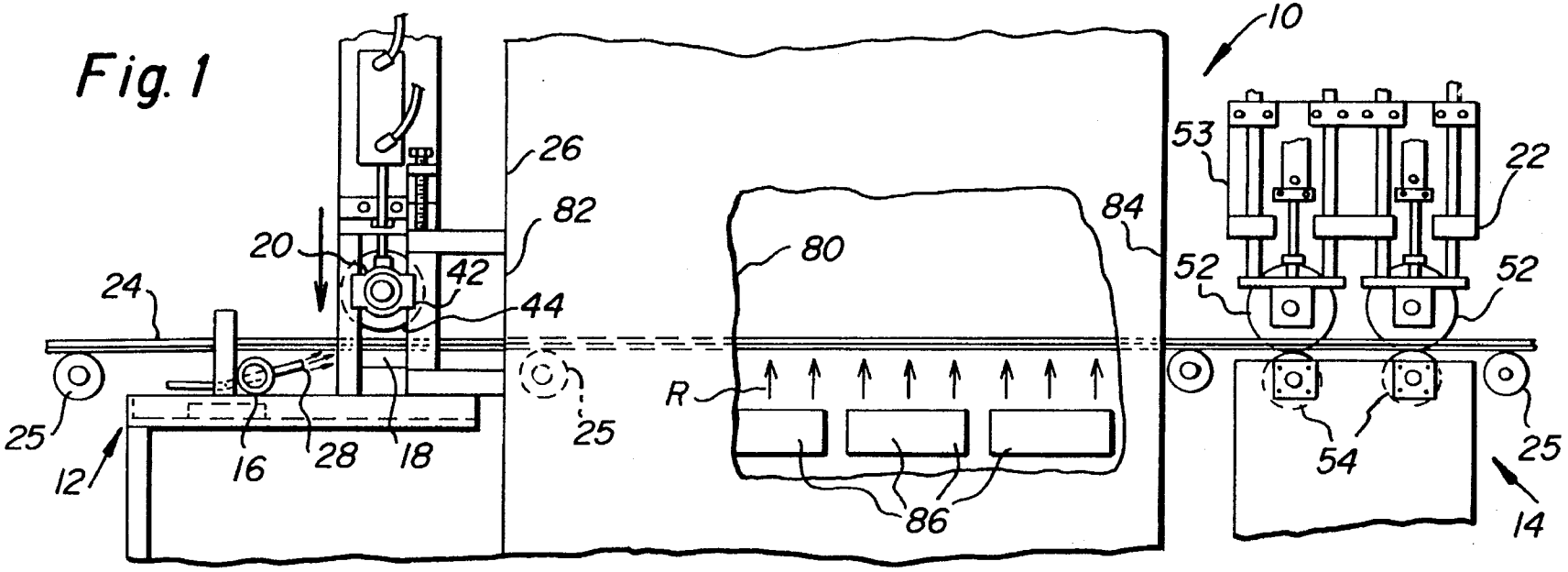
FIG. 1 is an overall schematic view of an apparatus for coating sheet materials in accordance with the present invention.

A coating apparatus 10 in accordance with the present invention is illustrated in FIG. 1. The apparatus 10 may be a single stage of a multistage forming and coating system as set forth in the above-identified co-pending application, or the system may be a stand alone unit, as shown.

The coating apparatus 10 has an inlet 12 and an outlet 14 and includes a sprayer 16 near the inlet 12, an applicator 18 mounted in a frame 19 downstream of the sprayer 16, a retractable backing roller 20 in opposition to the applicator 18 and a primary drive 22 downstream of the outlet 14. A supply of sheet material 24 is fed from the inlet 12 through the sprayer 16 and the applicator 18 to the outlet 14. The sheet material 24 may be supported by a series of rollers 25. An optional curing box 26 may be provided downstream of the applicator 18 to supply thermal and UV curing radiation R.

Figure 3:
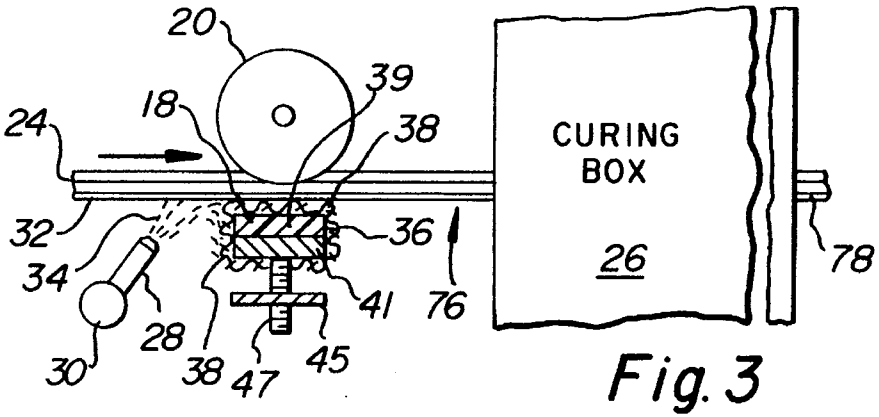
FIG. 3 is a fragmentary side view of the applicator.

The sprayer 16, shown in more detail in FIGS. 2 and 3, comprises a plurality of spray nozzles 28 connected to a manifold 30. In the exemplary embodiment, the sprayer nozzles 28 are directed at the underside 32 of the sheet material 24 and at the applicator 18 for delivering a stream 34 of coating material thereon.

The applicator 18, detailed in FIGS. 2 and 3, comprises a support member 36 and a compressible sleeve 38 formed of a resilient, compressible, saturable material covering the support member 36. The support member 36 is formed of a plurality of trapezoidal nylon blocks 39 secured to backing plate 41. The blocks 39 are secured to the plate 41 by screws 43. The support member 36 and the sleeve 38 are adapted to engage the underside 32 of the sheet 24. Adjustment plate 45 is secured to frame under the backing plate 41. A plurality of adjustment screws 47 are secured in threaded openings in the adjustment plate 45 for engaging the underside of the backing plate 41. Adjustment screws 47 allow for the adjustment of the pressure of the upper member 36 adjacent the sheet material 24.

In the exemplary embodiment, the sheet material 24 is corrugated, as shown, and the support member 36 has a corrugated surface 40 for engaging the underside of the sheet 24. The sleeve 38 conforms to the shape of the support 36, as shown.

The backing roller 20, detailed in FIGS. 1 and 3, is mounted on a retractable frame 42 transverse to the sheet 24 for engaging the applicator in opposition at the nip 44. The backing roller 20 comprises a core roller 46 and plurality of axially spaced rollers 48 for engaging the corrugations in the sheet 24, as shown. When the sheet 24 is located between the roller 20 and the applicator 18, the rollers 48 are adapted to engage the upperside 50 of the sheet 24 and urge the underside 32 against the conforming corrugated surface of the applicator 18, as shown.

The sheet 24 is drawn through the apparatus by means of a primary drive 22, detailed in FIGS. 1 and 4, located at the downstream end near the outlet 14. In the invention, the sheet material 24 may be thermo formed into clear corrugated sheet and then coated in the applicator 18 in a continuous process. Optionally, the sheet material 24 may be formed and cut to length and width for coating in the apparatus 10 at a later time. In either case, clear corrugated sheet useful for greenhouse applications is formed.

The primary drive 22, detailed in FIGS. 1 and 4, engages the sheet 24 downstream of the applicator 18 for drawing it therethrough at a selected draw rate. In the embodiment illustrated, the primary drive 20 comprises spaced apart pairs of upper drive rollers 52 retractably mounted in a frame 53 and paired lower backup rollers 54 also mounted in the frame 53. Each backup roller is formed of a metal core 56 which carries a resilient sleeve 58. Primary upper drive rollers 52 engage the sheet 24 from the upperside 50 and drive the sheet 24 in the upstream direction. The drive rollers 52 each generally comprise a metal core or shaft member 58 carrying a plurality of spaced apart annular drive wheels 59 for engaging the corrugations in the sheet material 24. Each drive wheel 59 has a resilient annular sleeve or cover 60. In operation, the drive rollers 52 and backup rollers 54 engage the sheet material 24 therebetween for drawing the sheet 24 through the apparatus 10.

Figure 5:
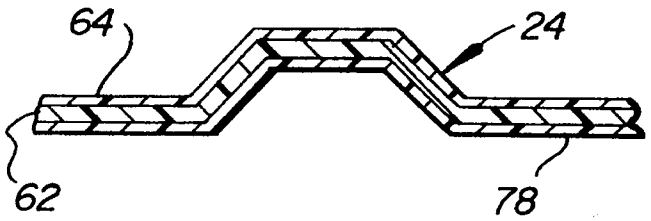
FIG. 5 is a fragmentary cross section of the coated sheet material.

The corrugated sheet 24, shown in FIG. 5, may be formed of raw materials comprising a base layer of polycarbonate flat sheet 62 that is coextruded with a UV stabilized cap layer 64. The thickness of the sheet 24 is dependent upon the application and the finished product thickness. Typically, the thickness for greenhouse applications is about 0.033 inch. The sheet 24 is formed in accordance with the teachings of the above-identified co-pending patent application, Ser. No. 07/960,089, and is not further detailed herein.

As illustrated in FIG. 3, the sprayer 16 directs the stream of liquid 34 against the underside 32 of the sheet 24 and towards the applicator 18. As the sheet 24 is drawn through the apparatus 10. The stream 34 floods the underside 32 upstream of the applicator 18 as well as the applicator. The sleeve 38 absorbs the liquid 34 and becomes saturated. Excess liquid material drains away. As the sheet 24 is drawn through the applicator 18, and uncured coating or film 76 is formed on the underside 32 of the applicator 18 downstream thereof. The film 76 may cure in air or it may be cured in the curing box 26 to a durable coating 78.

The curing box 26, detailed in FIG. 1, generally comprises an enclosed housing 80 having an open inlet or upstream end 82 and a downstream or outlet end 84. Disposed within the housing 80 are one or more curing elements 86 which may be heaters or UV light sources for producing the curing radiation R. The sheet material 24 is carried through the housing 80 from the inlet 82 to the outlet 84 past the curing elements 86. The draw rate is adjusted so that the uncured coating 76 cures on the underside 32 forming cured durable coating 78, as shown.

When the sheet material 24 has been coated, the spaced apart annular drive rollers 52 engage the sheet material 24 at the nip formed with the power driven backup rollers 54, between the corrugations without damaging the sheet material 22 and the coating 78.

In accordance with the invention, there has been provided a method for coating sheet material comprising movably carrying the sheet with at least one coatable side disposed in a downwardly facing direction and engaging the coatable side into contact with a resilient saturable applicator. A flooding stream of coating material is directed at the coatable side upstream of the applicator which becomes saturated with the liquid. Excess curable liquid is carried away without leaving noticeable optical defects in the coating. The coating thereafter dries or cures to a durable finish.

It is possible to coat the sheet from the upperside 50, if desired. However, it is necessary to allow the excess flooding stream 34 to drain away. It is preferred to coat the underside because, damage of excess coating material is easily facilitated, as discussed above.

Various coatings may be deposited in the manner described herein. For example, anti-drip coatings, such as polymers with free OH groups are useful as condensate coatings. An example of a useful condensate coating is a polyvinyl alcohol. Anti-scratch coatings may also be employed. For example, melamine formaldehyde, acrylics polyurethanes, polyols and polysiloxanes may also be employed.

The coating materials are supplied by spraying at a relatively viscosity, for example, about 6 centistokes at 25° C. It should be understood that various additives may be included in the coating materials, such as UV or thermal cure additives. The cure rate is typically less than a few seconds in air, under heat or under UV radiation.

The coated article is detailed in FIG. 5. As noted above, the sheet material 24 has a cured coating 78 deposited thereon. The preferred coating 78 is transparent and is deposited in accordance with the invention without visible defects. That is, any defects are not visible without instrumental assistance. In greenhouse applications, it is preferred that the coated sheet have a transmission of about 86 percent or better and a haze of less than 0.1.

The textile material forming the resilient sleeve 38 on the support member 34 may have an uncompressed thickness in a range of about 0.187 and about 0.125 inch. When the backing roller 20 and the applicator 18 are engaged the sleeve 38 may be compressed in a range of about 10 and about 75 percent. The sleeve is capable under a compression of about 50 percent to absorb the liquid 34 and become saturated. At the same time, the compressed, saturated sleeve 38 conforms to the corrugations in the sheet material 24, and doctors it without producing optical defects, such as bubbles and the like. A useful material for the sleeve is natural fibrous cotton. Other materials which may be wetted by the coating materials are also useful, such as polyesters and wool.

While there have been described what are at present considered to be the preferred embodiments of the present invention, it will be readily apparent to those skilled in the art that various changes and modifications may be made therein without departing from the invention, and it is intended in the appended claims to cover such changes and modifications as fall within the true spirit and scope of the invention.

What is claimed:

1. Apparatus for depositing a curable liquid condensate coating free of visible optical defects onto at least one coatable surface of a transparent sheet comprising:

means for movable carrying the sheet in a direction from an inlet to an outlet with the at least one coatable side;

applicator means between the inlet and the outlet disposed transverse to the direction of motion of the sheet for engaging the coatable side, said applicator means including a support surface which comprises at least one elongated polymeric block and a compressible saturable layer sleevably disposed on the support surface; and spray deposition means for directing a flooding stream of curable liquid onto the coatable side upstream of the applicator means, said applicator means becoming saturated with the curable liquid flood on the coatable side for coating the sheet with a layer of a selected thickness and carrying away excess curable liquid without producing visible defects on the sheet.

2. The apparatus of claim 1 further comprising a backing roller opposite the applicator means forming a nip for receiving the sheet therebetween.

3. The apparatus of claim 2 wherein the backing roller comprises a metallic cylindrical member.

4. The apparatus of claim 2 wherein the sheet is a corrugated sheet having corrugations and the backing roller includes roller portions for engaging the corrugations.

5. The apparatus of claim 4 wherein the backing roller comprises a plurality of cylindrical members on a common axis for engaging corresponding portions in the corrugated sheet.

6. The apparatus of claim 2 wherein the sheet is a corrugated sheet having corrugations and the applicator means includes surface portions shaped for conformably engaging the corrugations.

7. The apparatus of claim 1 wherein the saturable layer comprises a compressible textile web.

8. The apparatus of claim 7 wherein the textile web is formed of a material selected from the group consisting essentially of cotton, polyester and wool.

9. The apparatus of claim 7, wherein the textile web has a compressibility of at least about 75%.

10. The apparatus of claim 7, wherein the textile web has compressibility in a range of about 10% and about 75%.

11. The apparatus of claim 7 wherein the textile web has a thickness in a range of from about 0.125 inches to about 0.1875 inches.

12. The apparatus of claim 1 wherein the support surface comprises a plurality of polymeric block aligned with the direction of the sheet material from the inlet to the outlet.

13. The apparatus of claim 12 further including a support plate for supporting the polymeric blocks in spaced apart adjacent relationship.

14. The apparatus of claim 1 wherein the polymeric block is nylon.

* * * * *